US006389262B1

(12) United States Patent
Borg

(10) Patent No.: US 6,389,262 B1
(45) Date of Patent: May 14, 2002

(54) MEDIA REPRODUCTION SYSTEMS AND METHODS OF OPERATING MEDIA REPRODUCTION SYSTEMS

(75) Inventor: Michael J. Borg, Boise, ID (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/827,734

(22) Filed: Apr. 6, 2001

(51) Int. Cl.[7] ..... G03G 15/00
(52) U.S. Cl. ..... 399/368; 399/45; 399/370
(58) Field of Search ..... 399/45, 362, 365, 399/367, 368, 370

(56) References Cited

U.S. PATENT DOCUMENTS

| | | | | |
|---|---|---|---|---|
| 5,523,819 A | | 6/1996 | Frick | |
| 5,534,973 A | | 7/1996 | Harada | |
| 5,596,400 A | * | 1/1997 | Kasamatsu et al. | 399/45 |
| 5,734,809 A | | 3/1998 | Higuchi | 395/181 |
| 5,960,109 A | | 9/1999 | Shiau | 382/164 |
| 6,021,294 A | | 2/2000 | Schmidl et al. | 399/258 |
| 6,085,052 A | | 7/2000 | Yamane et al. | 399/111 |
| 6,122,462 A | | 9/2000 | Hintler | 399/77 |
| 6,134,021 A | | 10/2000 | Silverbrook | 358/1.18 |
| 6,163,668 A | | 12/2000 | Takahashi et al. | 399/144 |

* cited by examiner

*Primary Examiner*—Sophia S. Chen
*Assistant Examiner*—Hoang Ngo

(57) ABSTRACT

Reproduction systems and methods of operating reproduction devices are described. In one embodiment, a reproduction method comprises receiving multiple pages into a reproduction device for reproduction and positioning the multiple pages within an area in the reproduction device so that they can be reproduced. The multiple pages are scanned using a single scanning cycle, and a single reproduced page is output for each of the multiple pages that was scanned. In another embodiment, a copier comprises one or more processors, an image engine having a scan glass for receiving document pages and being configured to scan document pages and produce copies of the pages. A page feeding manager is associated with the one or more processors and is configured to cause pages to be fed into the copier and processed by the image engine. The page feeding manager is configured to automatically provide, onto an area of the scan glass that is designated to receive a single page having first length and width dimensions, at least two pages having length and width dimensions which are, respectively, less than the first length and width dimensions. The copier is configured to output corresponding single copied pages, one for each of the pages provided onto the scan glass.

26 Claims, 9 Drawing Sheets

MEDIA REPRODUCTION SYSTEMS AND METHODS OF OPERATING MEDIA REPRODUCTION SYSTEMS

TECHNICAL FIELD

The present invention relates generally to methods and systems that reproduce media and, more particularly concerns methods and systems that are directed to optimizing the use of media reproduction systems.

BACKGROUND

Media reproduction systems typically reproduce or make copies of media. One type of media reproduction system is a photocopier or copier. To operate a photocopier, a document that may have multiple pages is typically placed into a receptacle tray on the top of the photocopier. The document is fed, page by page, into the photocopier where it is positioned on a scan glass, scanned, reproduced, and then ejected into another receptacle tray.

FIG. 1 shows an exemplary copier generally at 100 with some typical elements depicted for purposes of explanation. Copier 100 comprises a feeder tray 102 that serves to receive documents that are to be copied, and a receptacle tray 104 that serves to collect individual pages after they have been copied. A belt assembly includes a belt 106 that physically engages individual pages, thus moving them between feeder tray 102 and receptacle tray 104, and through an imaging area that includes a scan glass 108. A scanner 110 is provided and scans individual pages on the scan glass. One or more job collection trays 112 can be provided to receive photocopied pages from the copier.

A typical process by which a multi-page document is photocopied is as follows. First, a single page is moved from feeder tray 102 to a position where it can be engaged by belt 106. Belt 106 then moves the single page to a predetermined position on scan glass 108. In this example, the belt moves in a clockwise direction. Once in the predetermined position on the scan glass, scanner 110 moves along a predetermined scan path (in the direction of the arrows), scanning the single page. When the scanner reaches the end of its scan path, it typically returns to a starting position to wait for the next page. In the illustration, scanner 110 is shown in the starting position. The scanned image is then processed by an image engine which makes one or more copies of the page. The page copies are then ejected into the job collection trays. After the individual page has been scanned, belt 106 moves the page to a position where it can be ejected into receptacle tray 104 and moves a next page onto the scan glass. This process continues until all of the pages in the feeder tray have been copied.

For additional background information on photocopiers and so-called multi-function printers, the reader is referred to the following U.S. Patents, the disclosures of which are incorporated by reference herein: U.S. Pat. Nos. 6,085,052, 6,021,294, 5,960,109, 5,734,809, 5,534,973, 5,523,819, 6,163,668, 6,134,021, and 6,122,462.

One of the problems associated with the above described process, and indeed, with other copying processes in general, is that they can tend to be inefficient from a time management standpoint. Specifically, each page of a document must typically be individually fed from a feeder tray onto the scan glass, scanned, and then ejected before the next page is positioned onto the scan glass.

Accordingly, this invention arose out of concerns associated with providing improved systems and methods for operating reproduction devices such as copiers, multi-function printers, and the like.

SUMMARY

Reproduction systems and methods of operating reproduction devices are described. In one embodiment, a reproduction method comprises receiving multiple pages into a reproduction device for reproduction and positioning the multiple pages within an area in the reproduction device so that they can be reproduced. The multiple pages are scanned using a single scanning cycle, and a single reproduced page is output for each of the multiple pages that was scanned.

In another embodiment, a reproduction method comprises providing an area on a scan glass of a copier that is designated to receive a single page having first length and width dimensions. At least two pages are automatically received onto the area, with each page having second length and width dimensions which are, respectively, less than the first length and width dimensions. The pages are copied to provide single copied pages, one copied page for each page received onto the area.

In another embodiment, a reproduction device comprises one or more processors, an image engine for scanning document pages and producing copies of the scanned pages under the influence of the one or more processors, and a page feeding manager configured to cause pages to be fed into the reproduction device and processed by the image engine. The page feeding manager is configured to receive multiple pages and position the multiple pages within an area in the reproduction device so that the multiple pages can be reproduced into separate individual copies using a single scanning cycle.

In a further embodiment, a copier comprises one or more processors, an image engine having a scan glass for receiving document pages and being configured to scan document pages and produce copies of the pages. A page feeding manager is associated with the one or more processors and is configured to cause pages to be fed into the copier and processed by the image engine. The page feeding manager is configured to automatically provide, onto an area of the scan glass that is designated to receive a single page having first length and width dimensions, at least two pages having length and width dimensions which are, respectively, less than the first length and width dimensions. The copier is configured to output corresponding single copied pages, one for each of the pages provided onto the scan glass.

DETAILED DESCRIPTION

Overview

Methods and systems for reproducing multiple pages are described. Economies are achieved by processing multiple pages at once, to provide multiple copied pages. In some embodiments, the multiple pages are processed in a reproduction device and within an area in the device that is designated for larger-dimensioned pages.

Exemplary Reproduction Device

Figure 1:
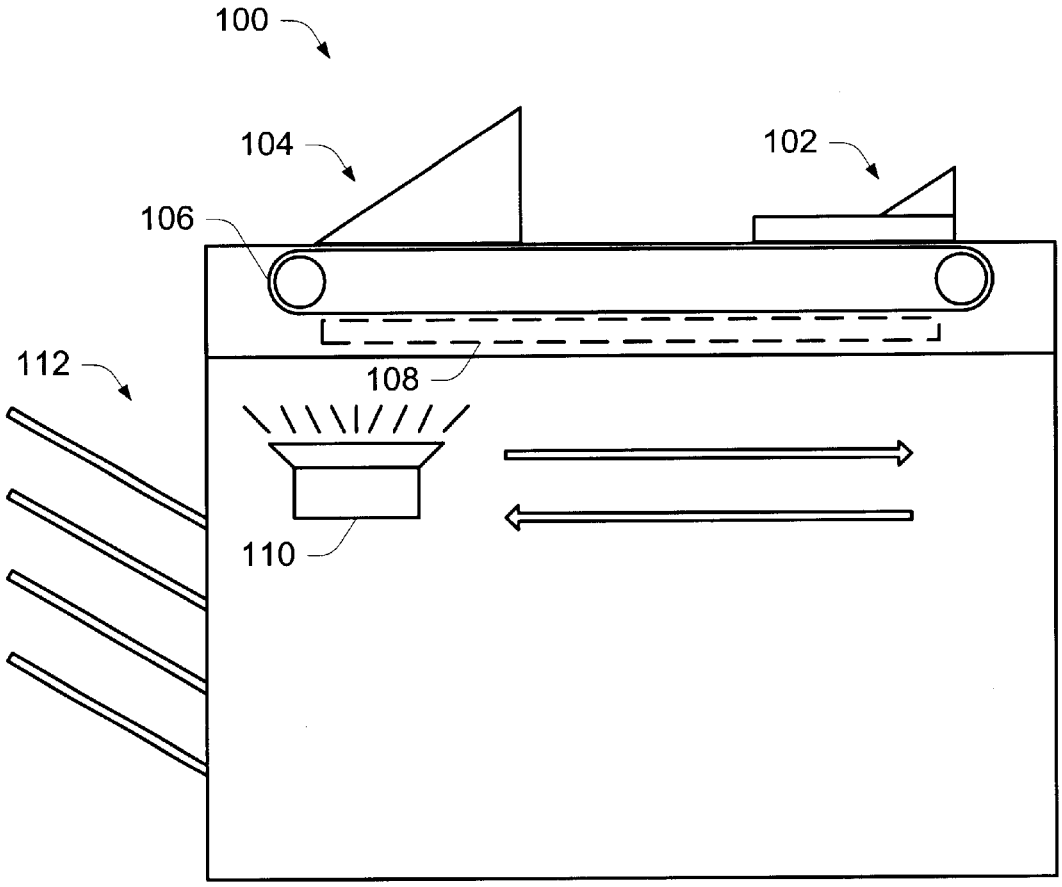
FIG. 1 is a block diagram that illustrates an exemplary reproduction device.
Figure 2:
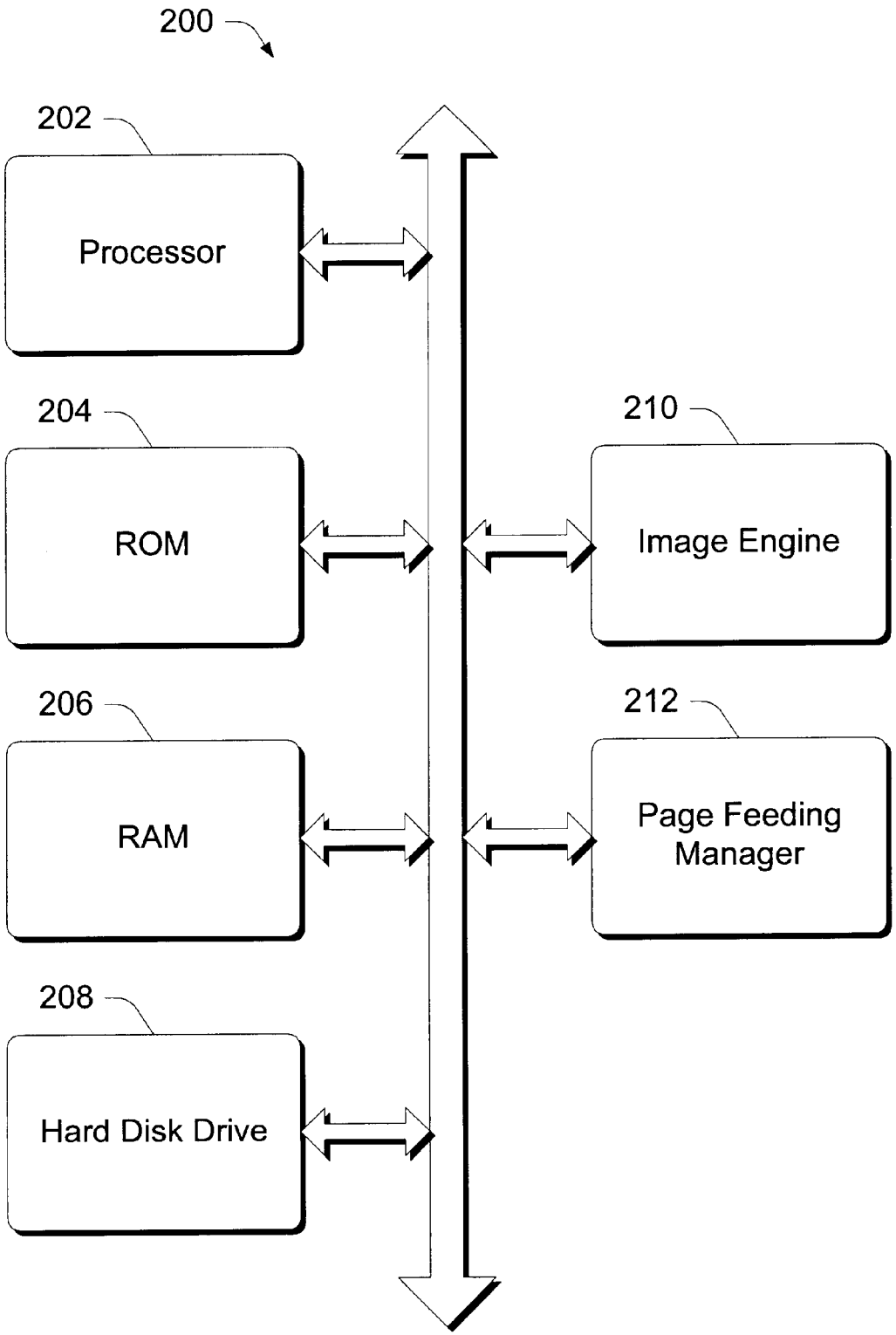
FIG. 2 is a block diagram that illustrates exemplary components of a reproduction device.

FIG. 2 shows an exemplary reproduction device in the form of a copier or multi-function printer system generally at 200. It is to be appreciated that the described components constitute but exemplary components only, and are not intended to limit application of the claimed subject matter to reproduction devices that include only these components. Accordingly, other reproduction devices having components different from and/or in addition to those described immediately below can be used in implementing the described techniques and systems.

Device 200 includes one or more processors 202 which can be any suitable processor that is typically used in reproduction device applications. ROM 204 and RAM 206 are provided and used for those functions that are typical for reproduction devices. A hard disk 208 can be provided for storage and can include software instructions that are loaded into the device's main memory for execution when the printer is operational. An image engine 210 is provided and is responsible for imaging document pages and producing copies of the pages. Exemplary image engines are described in some of the patents incorporated by reference above.

A page feeding manager 212 is also provided in accordance with the described embodiment and can be implemented in any suitable hardware, software, firmware or combination thereof. The page feeding manager can have many functions among which include causing pages to be fed into the reproduction device in accordance with the principles described below. Certain control aspects of the page feeding manager can be implemented in software instructions. These instructions, or the processes that the instructions are designed to implement, are described in this document in flow diagram form. The invention includes all forms of computer-readable media, when the media contain such software instructions.

Exemplary Embodiment

Figure 3:
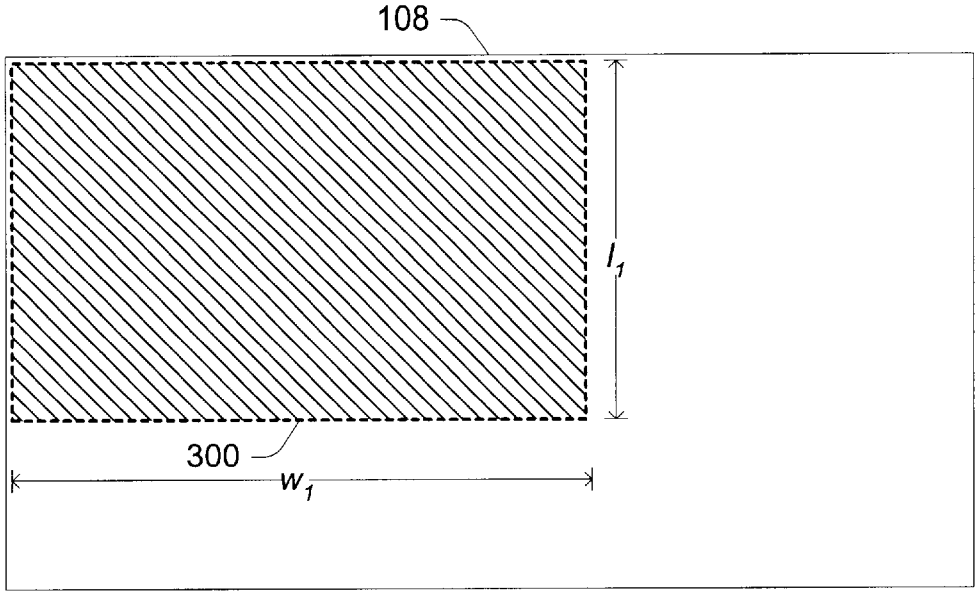
FIG. 3 is a top plan view of an exemplary scan glass having an area designated for receiving a page.

FIG. 3 shows a top plan view of an exemplary scan glass 108 that comprises part of a copier. Typically, reproduction devices are configured to accommodate and automatically copy documents having different dimensions. One such document is shown at 300 superimposed over the scan glass 108. Document 300 has length and width dimensions $l_1$ and $w_1$, respectively. The length and width dimensions are such that the total area of document 300 is less than the total area of scan glass 108 as shown. When document 300 is copied by a reproduction device, the scanner of the device typically scans along the document—in this case along $w_1$.

The inventor has recognized that multiple pages from other documents having dimensions that are different from those of document 300, can fit inside of, or in some cases, not exceed (or not meaningfully exceed) the area that is defined by the respective length and width dimensions $l_1$ and $w_1$, of document 300. Recognizing this, multiple pages from these other documents can be reproduced at the same time, when the reproduction device "believes" it is scanning a single document having the larger dimensions. Alternately, these multiple pages from these other documents can be reproduced at the same time when they are fed into the reproduction device in a manner such that they collectively occupy the area that is allotted for the single document having the larger dimension.

Figure 4:
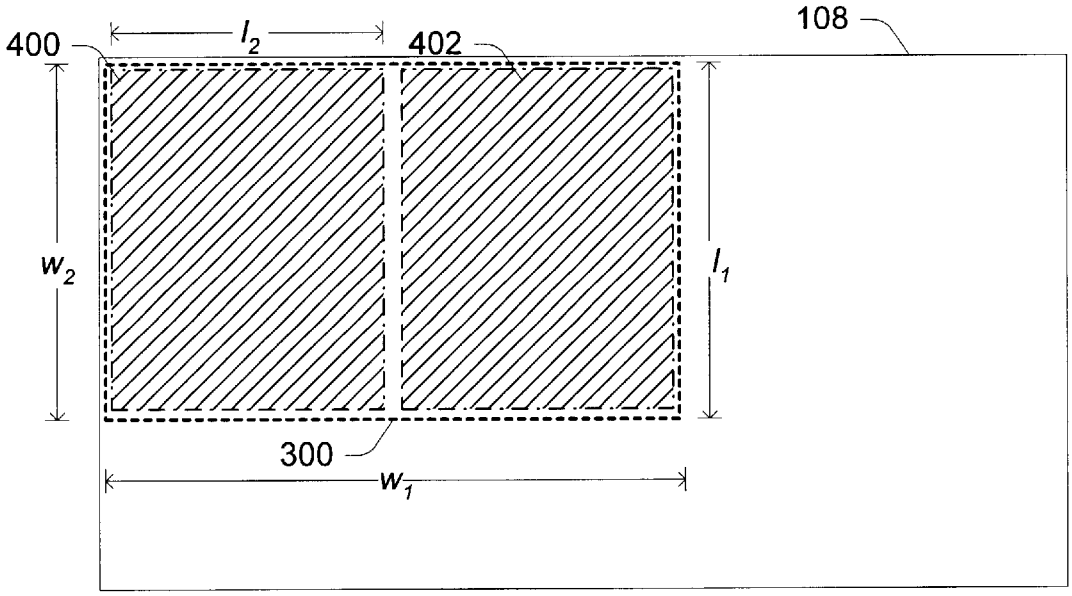
FIG. 4 is a top plan view of an exemplary scan glass having an area designated for receiving multiple pages.

Consider, for example, FIG. 4. There, two separate documents 400, 402 are shown in cross-hatched form. Each document has a length dimension $l_2$ and a width dimension $w_2$. Documents 400, 402 are shown superimposed on an area of scan glass 108 that is designated for document 300 (having the larger dimensions). In this example, $l_1=w_2$, and $l_2=\frac{1}{2}w_1$. That is, each of documents 400, 402 occupies half the area on the scan glass of the larger document 300. Accordingly, by providing multiple pages of a document onto an area of the scan glass that is designated for a larger-dimensioned document, individual copies of each of the multiple pages can be made in less time than it would take to copy each individual page by itself. This is for the following reason. Recall that in the past, each single page of a copy job had to be moved from a feeder tray to a position on the scan glass, scanned, and subsequently ejected before a next page was processed. To process two pages, for example, two scanning cycles were required. In the present case, to copy multiple pages of a smaller-dimensioned document, only one scanning cycle is required. In this example, and because of the particular dimensions of the larger- and smaller-dimensioned pages, the smaller-dimensioned pages are fed onto the scan glass in a manner such that their width dimensions extend along the length dimension of the larger-dimensioned page area. Similarly, the length dimension of the smaller-dimensioned page extends along the width dimension of the larger-dimensioned page area.

Figure 5:
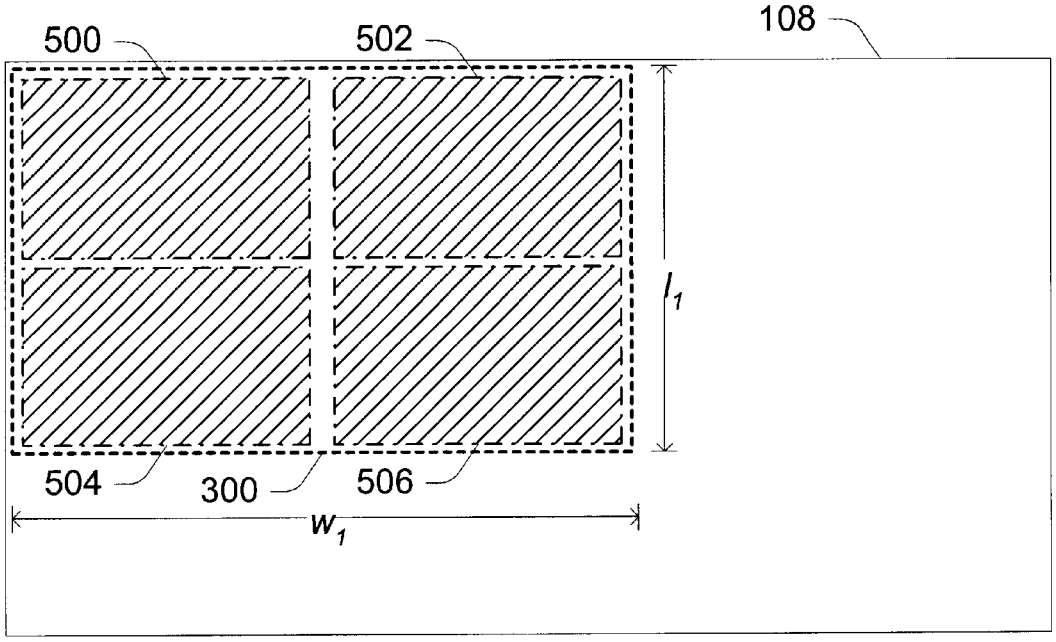
FIG. 5 is a top plan view of an exemplary scan glass having an area designated for receiving multiple pages.

Consider the economies that can be gained from this improvement by considering FIG. 5. There, four different documents 500, 502, 504, and 506 are provided onto scan glass within an area that is designated for a document 300.

Exemplary Processing Example

FIGS. 6–10 illustrate an example of how one particular copy job can be processed on a copier 600 in accordance with one embodiment. In this particular copy job, there are six pages numbered "1"–"6". The individual pages all have the same dimension, with such dimension being smaller than a dimension of a larger-dimensioned document that can be processed on a designated scan glass area of copier 600. As an example, consider that each of the individual pages is 8½×11 inches in dimension, and that the larger-dimensioned document that can be processed on copier 600 is an 11×17 inch document. In this case, two individual 8½×11 inch documents fit perfectly on the scan glass area designated for one 11×17 inch document. This coincides, for example, with the FIG. 4 view.

Figure 6:
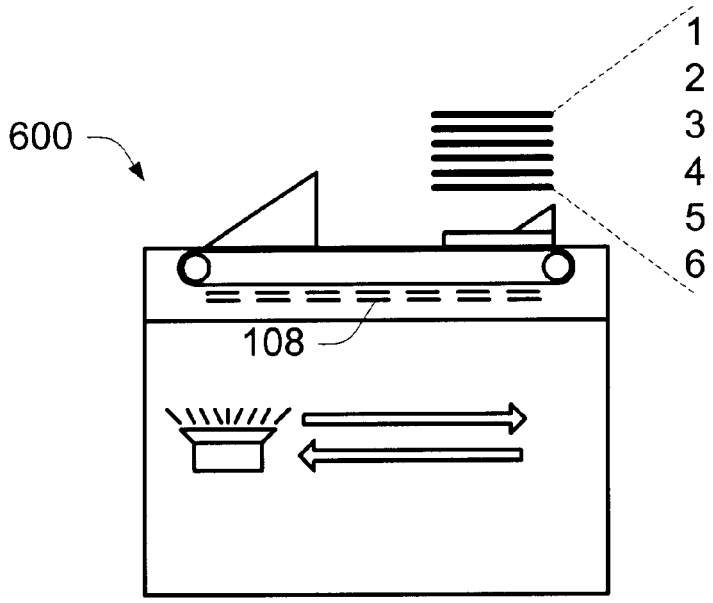
FIGS. 6–10 illustrate an exemplary copier processing multiple pages in accordance with one embodiment.
Figure 7:
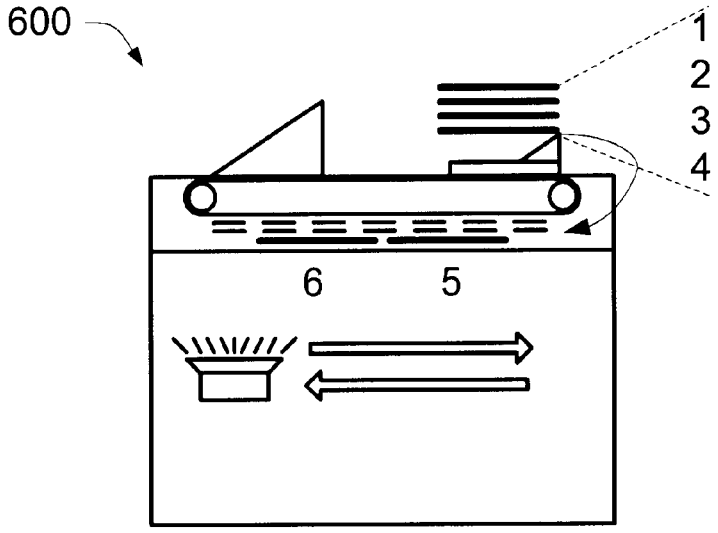
Figure 8:
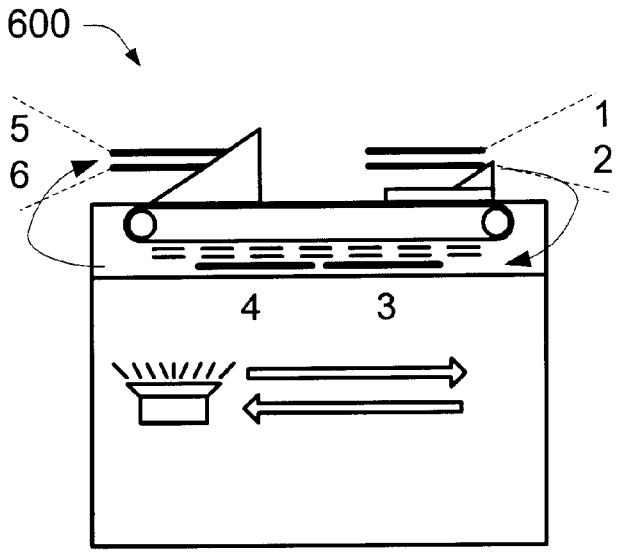
Figure 9:
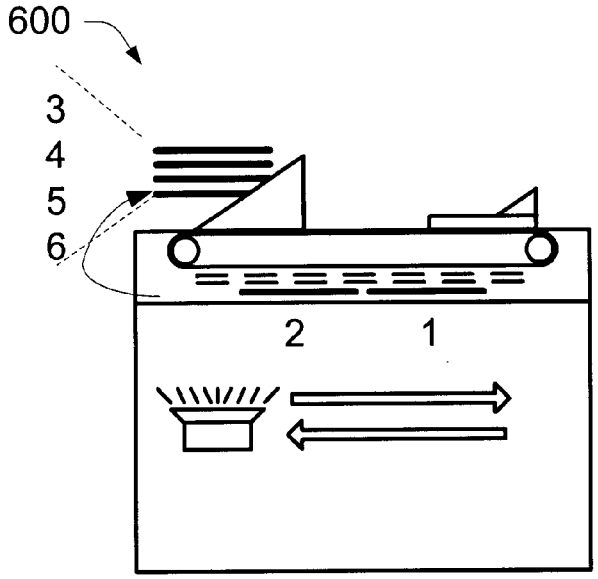
Figure 10:
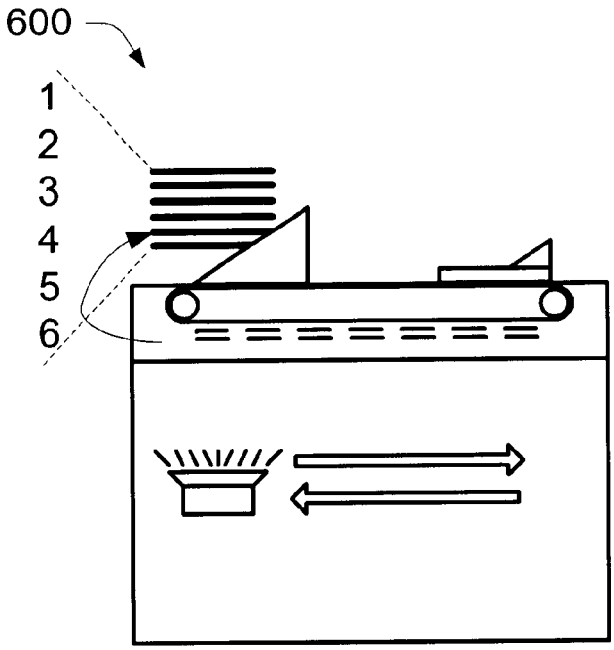

FIG. 6 shows all of the six pages awaiting processing in a feeder tray on copier 600. Two pages of the copy job are first fed into the copier and positioned on the scan glass for copying. Each of the individual pages is positioned within a scan glass area designated for a larger-dimensioned document. In the present example, pages 6 and 5 are the first pages that are processed for copying. FIG. 7 shows pages 6 and 5 in the relative positions that they occupy on the scan glass of copier 600. When pages 6 and 5 have been scanned and copied, they are ejected into a receptacle tray and pages 4 and 3 are next fed onto the scan glass and positioned in a manner similar to pages 6 and 5. FIG. 8 shows the state of copier 600 after such operation. After pages 4 and 3 are scanned and copied, they too are ejected and pages 2 and 1 are next fed onto the scan glass and positioned for copying. FIG. 9 shows the state of copier 600 after such operation. Finally, after copying pages 2 and 1, they are ejected into the receptacle tray. FIG. 10 shows the state of copier 600 after such operation.

Page-Feeding Mechanism

In the illustrated examples, the copiers may or may not have page-feeding mechanisms that are different from those that are in conventional use today. In the present examples, the page-feeding mechanism can be managed by and comprise part of the page-feeding manager 212 (FIG. 2). Whether different page-feeding mechanism are used depends, in part, on the type of paper-feeding operation that is going on. As an example, consider the following.

FIG. 4 shows an example where two smaller-dimensioned pages are positioned on the scan glass in an area designated for a larger-dimensioned page. In this example, the page-feeding mechanism can simply continuously feed two pages, in a serial fashion, to the position shown in the figure. In this case, the two discrete pages would be effectively treated as one contiguous page. It is possible, however, for some constructions to feed two pages onto the scan glass in a non-contiguous manner. In this case, the page-feeding mechanism can feed a first of the pages onto the scan glass so that it occupies a first position, and then feed a second of the pages onto the scan glass so that it occupies a second position adjacent the first page. As an example, consider FIG. 11.

Figure 11:
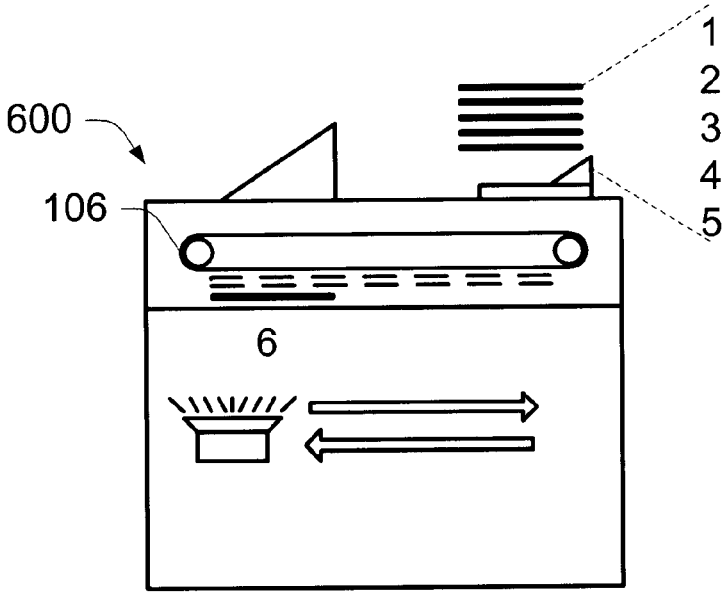
FIGS. 11–12 illustrate an exemplary copier processing multiple pages in accordance with one embodiment.
Figure 12:
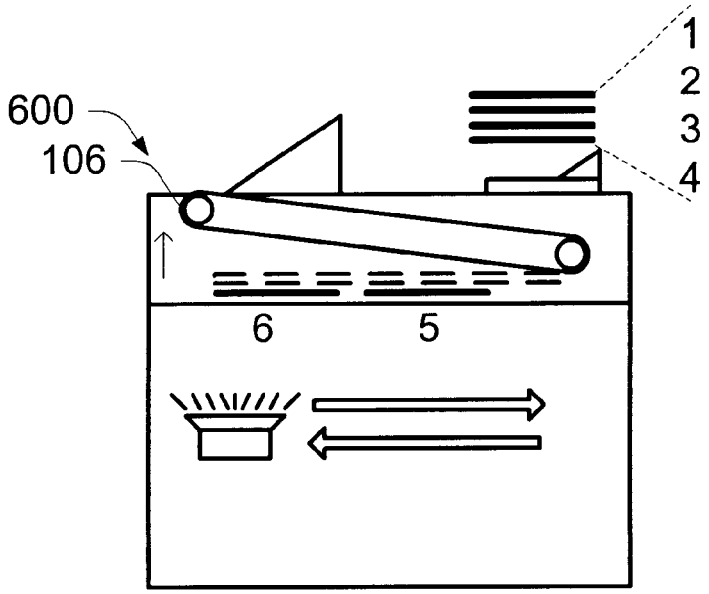

There, belt 106 receives page 6 and advances the page over the scan glass until it reaches the first position mentioned above. The belt or belt assembly can then reposition itself so that it can engage and advance the next page, without dislodging the first page. FIG. 12 shows one example where the left side of the belt assembly tilts upwardly so that only the right portion of belt 106 engages the next page—in this example page 5. The right portion of belt 106 then advances page 5 to the second position adjacent the first position. When scanning is completed, the belt assembly can then reposition itself as shown in FIG. 11 so that both pages can be ejected.

It will be appreciated and understood that other belt or belt assembly manipulations can take place to effect the positioning of the pages to be copied. For example, the belt assembly may remain in a substantially horizontal position, with only the belt itself being deformed or moved to effect the transfer of multiple pages.

Figure 13:
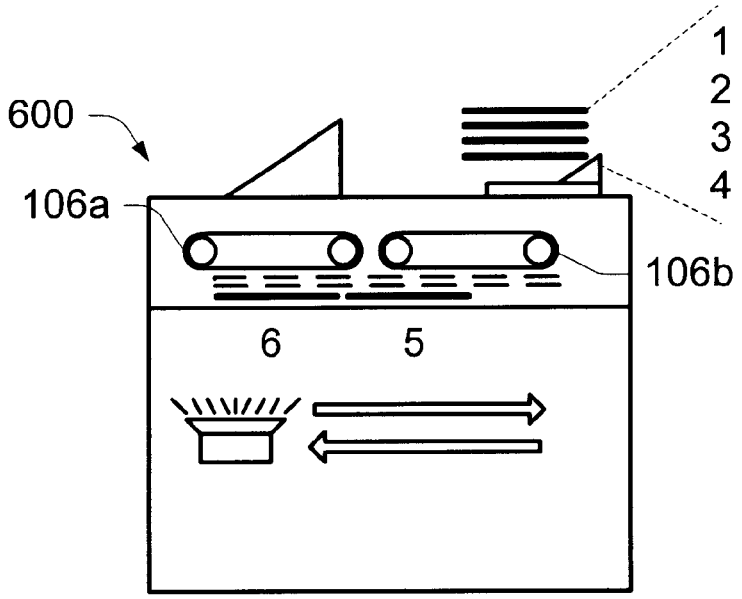
FIG. 13 illustrates an exemplary copier processing multiple pages in accordance with one embodiment.

FIG. 13 shows another exemplary copier 600 that includes a belt assembly having multiple different belts. In this example, two such belts 106*a* and 106*b* are shown. It is to be appreciated, however, that any suitable number of belts can be provided. In this example, a first of the pages to be copied is engaged first by belt 106*b* and advanced along the scan glass until it reaches and is engaged by belt 106*a*. Belt 106*a* then advances the first page to the first position. In this example, the first position is the position occupied by page 6. Once the first page is secure in the first position, the first belt is deactivated. Next, the second belt 106*b* engages and advances the second page—here page 5, to the second position as shown. With both pages now in position, copying can take place. When the pages are to be ejected, both of the belts can be used.

A point to remember here is that any practicable configuration of page-feeding mechanism can be designed to feed pages into and out of the copier, depending on the dimension of the potential pages that are to be copied, the desired orientation of the pages while they await advancement onto the scan glass, and the desired orientation and ordering of pages as they exit the scan glass.

User Interface

Figure 14:
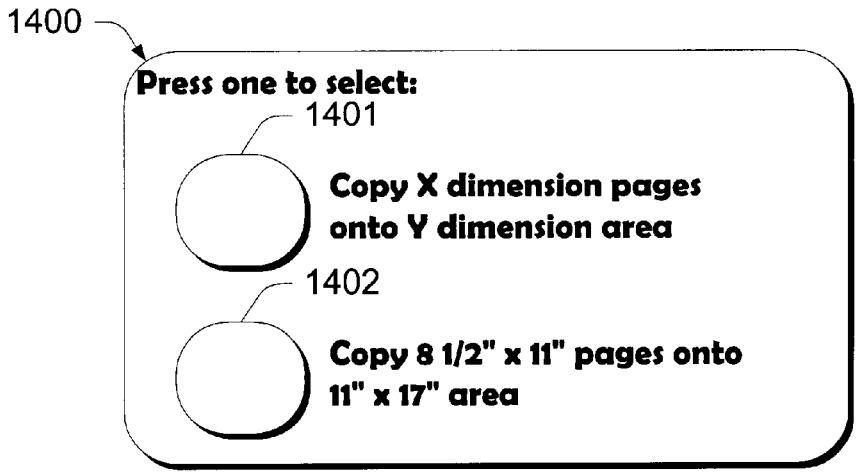
FIG. 14 illustrates an exemplary user interface that can be provided in accordance with one embodiment.

A user interface can be provided and configured to enable a user to select one or more options associated with copying multiple smaller-dimensioned pages on a scan glass area designated for a larger-dimensioned page. As an example, consider FIG. 14 which shows but one exemplary user interface 1400. User interface 1400 includes two possible selections 1401, 1402. Selection 1401 permits a user to copy X dimension pages onto a Y dimension area on the scan glass, where X is smaller than Y. Any suitable values can be provided for X and Y. Selection 1402 permits a user to copy 8½ inch×11 inch pages onto an 11 inch×17 inch scan glass area. When a user selects either of the choices, software resident in the copier ensures that the pages are fed properly and that the correct number of copies are made.

Ascertaining Document Boundaries

When multiple smaller-dimensioned pages are copied on an area of the scan glass that is designated for larger dimensioned pages, a few adjustments can be made to ensure that the correct number of pages are actually output from the copier. Specifically, consider FIG. 4 where two smaller-dimensioned pages 400, 402 are positioned on a scan glass within an area designated for a larger-dimensioned document 300. For scanning purposes, the scanner can treat the two pages as if they were one single large-dimensioned page. That is, the scanner scans the two pages as if they were one larger-dimensioned page. The copier, however, is aware that there are two smaller-dimensioned pages occupying an area that is normally designated for a single larger-dimensioned page. The copier is aware of this fact because either it is aware that it automatically fed two such pages onto the scan glass, or a user instructed the copier to do so via a user interface such as the one described in FIG. 14.

When a scan image is processed by the copier's software, the software can search for document boundaries, such as the adjacent edges of the separate pages, and divide the scan image accordingly so that two (or more) separate pages are output. Known boundary searching techniques and algorithms can be used, as will be apparent to those of skill in the boundary searching art. Alternately, the copier's software can simply divide the scan image into portions that correspond to the individual separate pages that are to be copied, and thus produce separate copied pages. For example, in FIG. 4, the software can be configured to simply divide $w_1$ in half, and then process the scan image as two separate scan images having dimension $w_1 \times w_1/2$.

Other techniques can, of course, be utilized to ascertain document boundaries, with the above examples constituting but two exemplary, nonlimiting approaches.

Exemplary Methods

Figure 15:
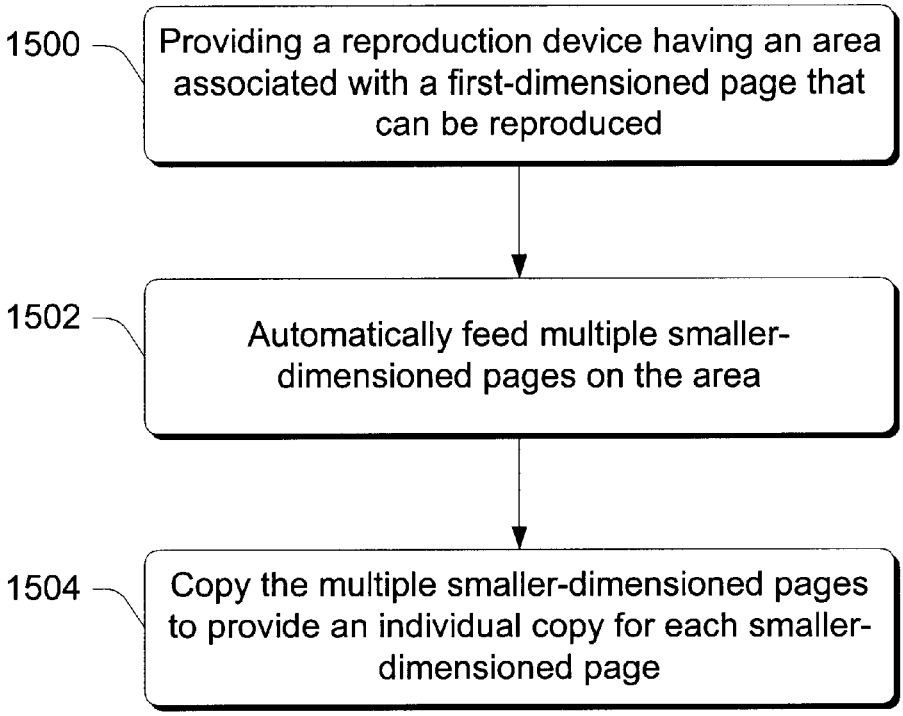
FIG. 15 is a flow diagram that describes steps in a method in accordance with one embodiment.

FIG. 15 is a flow diagram that describes steps in a method in accordance with one embodiment. Various steps in the method can be implemented in software.

Step 1500 provides a reproduction device having an area that is associated with a first-dimensioned page that can be reproduced. Any suitable reproduction device can be provided. Exemplary non-limiting examples of such devices include photocopiers (including color copiers) and multi-function printers. Step 1502 automatically feeds multiple smaller-dimensioned pages onto the area. Any suitable or practicable number of smaller-dimensioned pages can be employed. In the examples above, the multiple pages have the same dimension. Such need not, however, be the case. Additionally, in the illustrated examples, the multiple smaller-dimensioned pages were sufficient in number to entirely fill the area associated with the first-dimensioned page. Such need not, however, be the case. Specifically, it is possible for the smaller-dimensioned pages to less than fill the area and, in some instances, leave subareas open. Step 1504 copies the multiple smaller-dimensioned pages to provide an individual copy for each smaller-dimensioned page.

CONCLUSION

Advantages of the presently-described embodiments include time savings in copying multiple pages. In some instances, copy times can be reduced by half and even more. This can facilitate copier use in high traffic areas such as busy offices and the like.

Although the invention has been described in language specific to structural features and/or methodological steps, it is to be understood that the invention defined in the appended claims is not necessarily limited to the specific features or steps described. Rather, the specific features and steps are disclosed as preferred forms of implementing the claimed invention.

What is claimed is:

1. A method of operating a reproduction device comprising:

receiving multiple pages into a reproduction device for reproduction;

positioning the multiple pages within an area in the reproduction device so that they can be reproduced by the reproduction device, said area being designated for a document having larger dimensions than dimensions of individual pages of said multiple pages;

scanning the multiple pages using a single scanning cycle comprising the scanning cycle of the document having the larger dimensions; and outputting a single reproduced page for each of the multiple pages that was scanned.

2. The method of claim 1, wherein the multiple pages have length dimensions that are the same and width dimensions that are the same.

3. The method of claim 1, wherein the multiple pages have length dimensions that are the same and width dimensions that are the same, and said positioning positions the pages within an area that is equivalent to the collective areas of the multiple pages.

4. The method of claim 1, wherein the multiple pages comprise 8½"×11" pages.

5. The method of claim 4, wherein said area is dimensioned for accommodating an 11"×17" page.

6. The method of claim 1, wherein the multiple pages have length dimensions that are the same and width dimensions that are the same, and the area has length and width dimensions where the area's length dimension is less than the area's width dimension, and said positioning comprises positioning the multiple pages so that their length dimensions extend along the width dimension of the area.

7. The method of claim 1, wherein said receiving comprises receiving two pages.

8. The method of claim 1, wherein said receiving comprises receiving four pages.

9. One or more computer-readable media having computer-readable instructions thereon which, when executed by a reproduction device, cause the reproduction device to:

receive multiple pages for reproduction, the multiple pages all having length dimensions that are the same and width dimensions that are the same;

position the multiple pages within an area in the reproduction device so that they can be copied, said area having length and width dimensions, where the area's length dimension is less than the area's width dimension, said area being designated for a document having larger dimensions than dimensions of individual pages of said multiple pages, the multiple pages being positioned so that their length dimensions extend along the width dimension of the area;

scan the multiple pages using a single scanning cycle comprising the scanning cycle of the document having the larger dimensions; and output a single reproduced page for each of the multiple pages that was scanned.

10. The computer-readable media of claim 9, wherein the instructions cause the reproduction device to position two pages within said area.

11. The computer-readable media of claim 9, wherein the instructions cause the reproduction device to position four pages within said area.

12. A method of operating a copier comprising:

providing an area on a scan glass of a copier that is designated to receive a single page having first length and width dimensions;

automatically receiving onto the area at least two pages having second length and width dimensions which are, respectively, less than the first length and width dimensions; and copying said at least two pages to provide single copied pages, one copied page for each page received onto the area.

13. The method of claim 12, wherein said copying comprises scanning said pages using a single scanning cycle.

14. The method of claim 12, wherein the area's width dimension is greater than the area's length dimension, and said receiving comprises receiving said pages such that their width dimensions extend along the length dimension of the area.

15. The method of claim 12, wherein said receiving comprises receiving 8½"×11" pages onto an area sized to receive 11"×17" pages.

16. A reproduction device comprising:

one or more processors;

an image engine for scanning document pages and producing copies of the scanned pages under the influence of the one or more processors; and a page feeding manager associated with the one or more processors and configured to cause pages to be fed into the reproduction device and processed by the image engine, the page feeding manager being configured to:

receive multiple pages; and position the multiple pages within an area in the reproduction device so that the multiple pages can be reproduced into separate individual copies using a single scanning cycle, said area being designated for a document having larger dimensions than dimensions of individual pages of said multiple pages, said scanning cycle comprising the scanning cycle of the document having the larger dimensions.

17. The reproduction device of claim 16, wherein the page feeding manager is configured to receive multiple pages all of which have length dimensions that are the same, and width dimensions that are the same.

18. The reproduction device of claim 16, wherein the page feeding manager is configured to receive multiple pages all of which have length dimensions that are the same, and width dimensions that are the same, the page feeding manager further being configured to position the multiple pages within an area that is equivalent to the collective areas of the multiple pages and which is designated for receiving a single larger-dimensioned page.

19. The reproduction device of claim 16, wherein the page feeding manager is configured to receive multiple pages comprising 8½"×11" pages.

20. The reproduction device of claim 19, wherein said area is dimensioned for accommodating an 11"×17" page.

21. The reproduction device of claim 16, wherein the page feeding manager is configured to receive multiple pages all of which have length dimensions that are the same, and width dimensions that are the same, said area having length and width dimensions where the area's length dimension is less than the area's width dimension, and said page feeding manager being configured to position the multiple pages so that their length dimensions extend along the width dimension of the area.

22. The reproduction device of claim 16, wherein the page feeding manager is configured to receive four pages at a time.

23. A copier comprising:

one or more processors an image engine having a scan glass for receiving document pages, the image engine being configured to scan document pages and produce copies of the pages under the influence of the one or more processors;

a page feeding manager associated with the one or more processors and configured to cause pages to be fed into the copier and processed by the image engine, the page feeding manager being configured to:

automatically provide onto an area of the scan glass that is designated to receive a single page having first length and width dimensions, at least two pages having length and width dimensions which are, respectively, less than the first length and width dimensions, the copier being configured to output corresponding single copied pages, one for each of said at least two pages.

24. The copier of claim 23, wherein the copier is configured to produce said single copied pages using a single scanning cycle.

25. The copier of claim 23, wherein the width dimension of the area is greater than the length dimension of the area, the page feeding manager being configured to provide said pages onto the area such that the pages'width dimension extend along the area length dimension.

26. The copier of claim 23, wherein said area is sized to receive 11"×17" pages.

* * * * *